US007445357B2

(12) United States Patent
Behar et al.

(10) Patent No.: US 7,445,357 B2
(45) Date of Patent: Nov. 4, 2008

(54) LAMP

(75) Inventors: Yves Behar, Oakland, CA (US); Jacques L. Gagne, Los Gatos, CA (US); George Janour, Santa Cruz, CA (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 11/746,180

(22) Filed: May 9, 2007

(65) Prior Publication Data

US 2008/0062687 A1 Mar. 13, 2008

Related U.S. Application Data

(60) Provisional application No. 60/746,837, filed on May 9, 2006.

(51) Int. Cl.
*F21V 29/00* (2006.01)

(52) U.S. Cl. ..... 362/294; 362/410; 362/231; 362/800

(58) Field of Classification Search ..... 362/294, 362/410, 411, 433, 227, 231, 230, 800
See application file for complete search history.

(56) References Cited

U.S. PATENT DOCUMENTS

| | | | | |
|---|---|---|---|---|
| D122,711 | S | 9/1940 | May | |
| D301,632 | S | 6/1989 | Lohrentz | |
| 4,939,428 | A | 7/1990 | DePauli | |
| 5,034,863 | A | 7/1991 | Huang | |
| D320,865 | S | 10/1991 | Chang | |
| D329,098 | S | 9/1992 | Lu | |
| 5,336,979 | A | 8/1994 | Watson et al. | |
| 5,485,058 | A | 1/1996 | Watson et al. | |
| D376,440 | S | 12/1996 | Chan | |
| 5,621,283 | A | 4/1997 | Watson et al. | |
| 5,785,418 | A | 7/1998 | Hochstein | |
| 5,857,767 | A | 1/1999 | Hochstein | |
| 6,045,240 | A | 4/2000 | Hochstein | |
| 6,150,774 | A | 11/2000 | Mueller et al. | |
| 6,398,384 | B2 | 6/2002 | Siminovitch et al. | |
| 6,428,189 | B1 | 8/2002 | Hochstein | |
| 6,517,218 | B2 | 2/2003 | Hochstein | |
| 6,608,617 | B2 | 8/2003 | Hoffknecht et al. | |
| 6,641,284 | B2 | 11/2003 | Stopa et al. | |
| 6,864,513 | B2 | 3/2005 | Lin et al. | |
| 6,871,981 | B2 | 3/2005 | Alexanderson et al. | |
| 6,888,322 | B2 | 5/2005 | Dowling et al. | |
| 6,894,901 | B2 * | 5/2005 | Simon | 361/707 |
| 6,920,046 | B2 * | 7/2005 | Spryshak | 361/704 |
| D513,088 | S | 12/2005 | Baarman et al. | |
| 2003/0058650 | A1 | 3/2003 | Shih | |
| 2004/0052076 | A1 | 3/2004 | Mueller et al. | |
| 2004/0052077 | A1 | 3/2004 | Shih | |

(Continued)

*Primary Examiner*—Laura Tso
(74) *Attorney, Agent, or Firm*—Barnes & Thornburg LLP

(57) ABSTRACT

An assembly for use with a lamp including the lights, structures for dissipating heat, and controls for controlling the intensity and light temperature emitted by the assembly. Included are structures which allow the lamp to adjust the assembly to a desired position and a small compact configuration. The assembly can be used in a variety of lighting configurations including a desk lamp, floor lamp, wall lamp, ceiling or suspended lamp. A printed circuit board carries the lights and is sandwiched between two heat sinks for dissipating heat from the lights. Passages and openings are provided in the assembly for dissipating heat. A lenses are provided relative to the lights.

41 Claims, 12 Drawing Sheets

U.S. PATENT DOCUMENTS

2004/0156199 A1 8/2004 Rivas et al.
2004/0212321 A1 10/2004 Lys et al.
2004/0257815 A1 12/2004 Popovich et al.
2004/0264195 A1 12/2004 Chang et al.
2005/0047134 A1 3/2005 Mueller et al.
2005/0116665 A1 6/2005 Colby et al.
2005/0122018 A1 6/2005 Morris
2005/0135093 A1 6/2005 Alexanderson et al.
2007/0081338 A1* 4/2007 Kuan ..... 362/294

* cited by examiner

LAMP

CROSS-REFERENCE TO RELATED PATENT APPLICATION

This patent application claims the benefit of priority under 35 U.S.C. § 119(e) to U.S. Provisional Patent Application No. 60/746,837 filed May 9, 2006. The disclosures set forth in the referenced provisional application is incorporated herein by reference in their entirety, including all information as originally submitted to the United States Patent and Trademark Office.

BACKGROUND

This disclosure relates generally to a lamp having an arm with a head assembly including a plurality of lights. The lamp includes structures and methods for dissipating heat from the head assembly. The lamp also includes controls and methods for operating the lamp to control the light intensity and temperature emitted by the lamp.

By way of background, a variety of lamps have been designed which include a base, body and arm. Some form of light or illumination device is provided generally on a distal end of the arm. One of the problems that occurs with such lighting structures is that heat from the lights tends to accumulate making the distal end of the arm hot. Heating the arm may be undesirable to touch and may have a negative effect on the life of the lights. It would be preferable to provide a lamp which dissipates heat and prevents the accumulation of heat energy in at least the head assembly of the arm.

Additionally, a variety of lights have been developed which use solid state lighting technology such as light emitting diodes (LED) as the light source. Generally there has been little development on the control of the LED lights in order to control the "temperature" of the light emitted by the lamp. The temperature is related to the frequency of the light or the place the light falls on the spectrum. Light shifted towards infrared range of the spectrum is considering to be "warm" and light shifted towards the ultraviolet range of the spectrum is considered to be "cool". It would be desirable to provide an LED light which provides control of the light temperature and the intensity of the chosen light temperature emitted by the lamp.

BRIEF DESCRIPTION OF THE DRAWINGS

The present disclosure will be described hereafter with reference to the attached drawings which are given as a non-limiting example only, in which.

Figure 1:
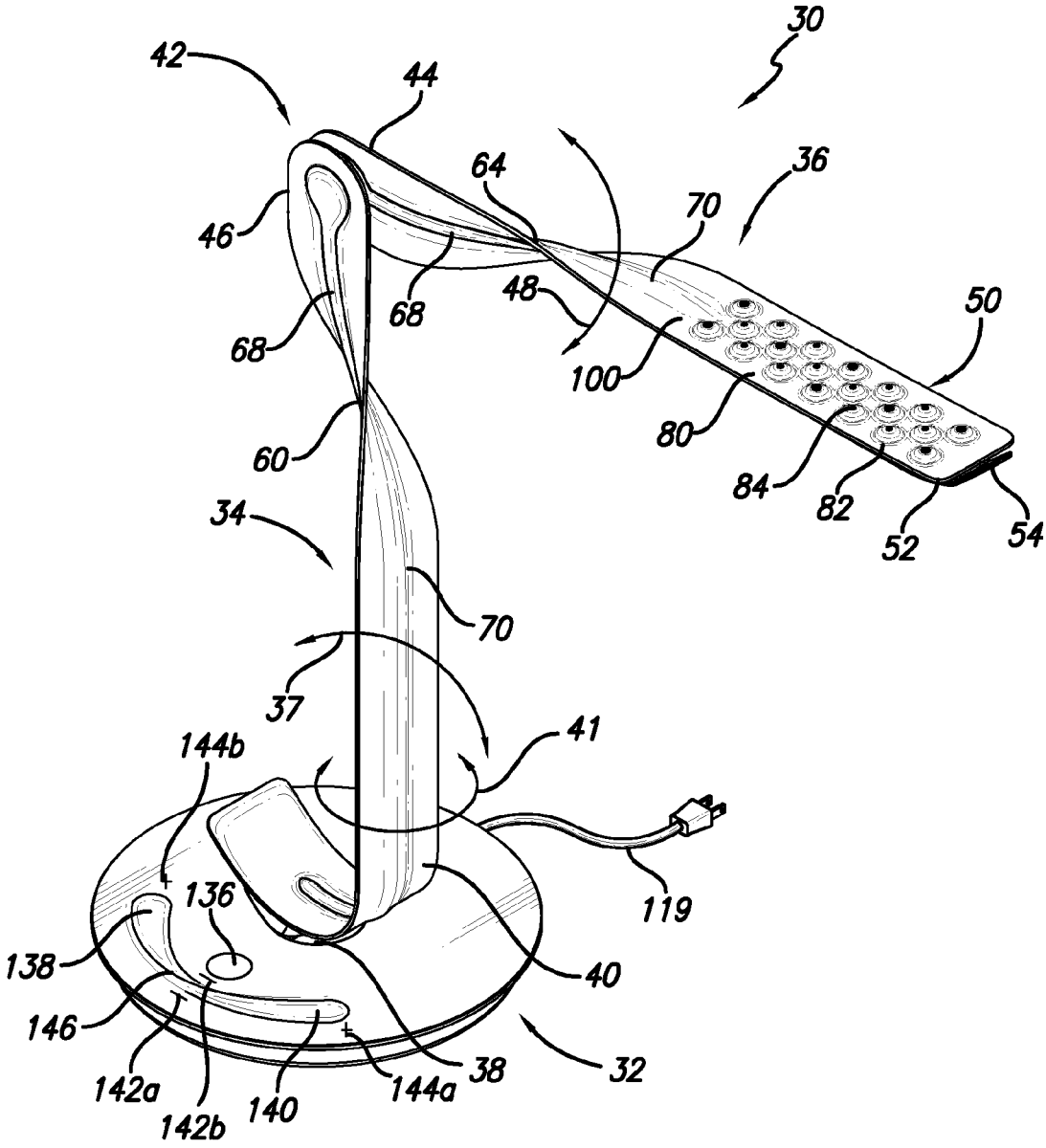
FIG. 1 is a perspective view of a lamp as disclosed having a base, a stem or body extending from the base, and an arm extending from the body, a first joint is provided by between the base and the body and a second joint is provided between the body and the arm, a head assembly extends from a distal end of the arm and provides illumination from the lamp.
Figure 2:
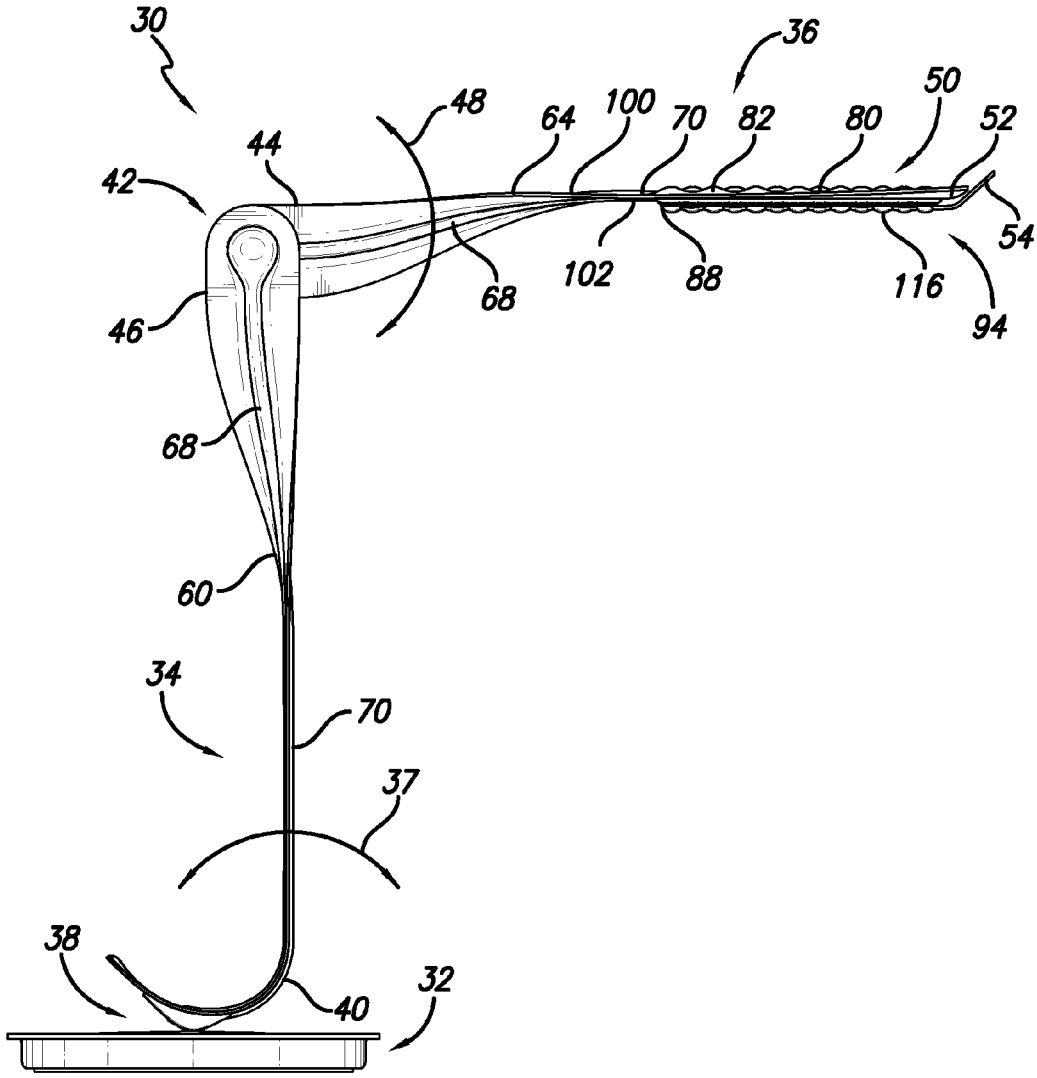
FIG. 2 is a side elevational view of the lamp as disclosed in FIG. 1.
Figure 3:
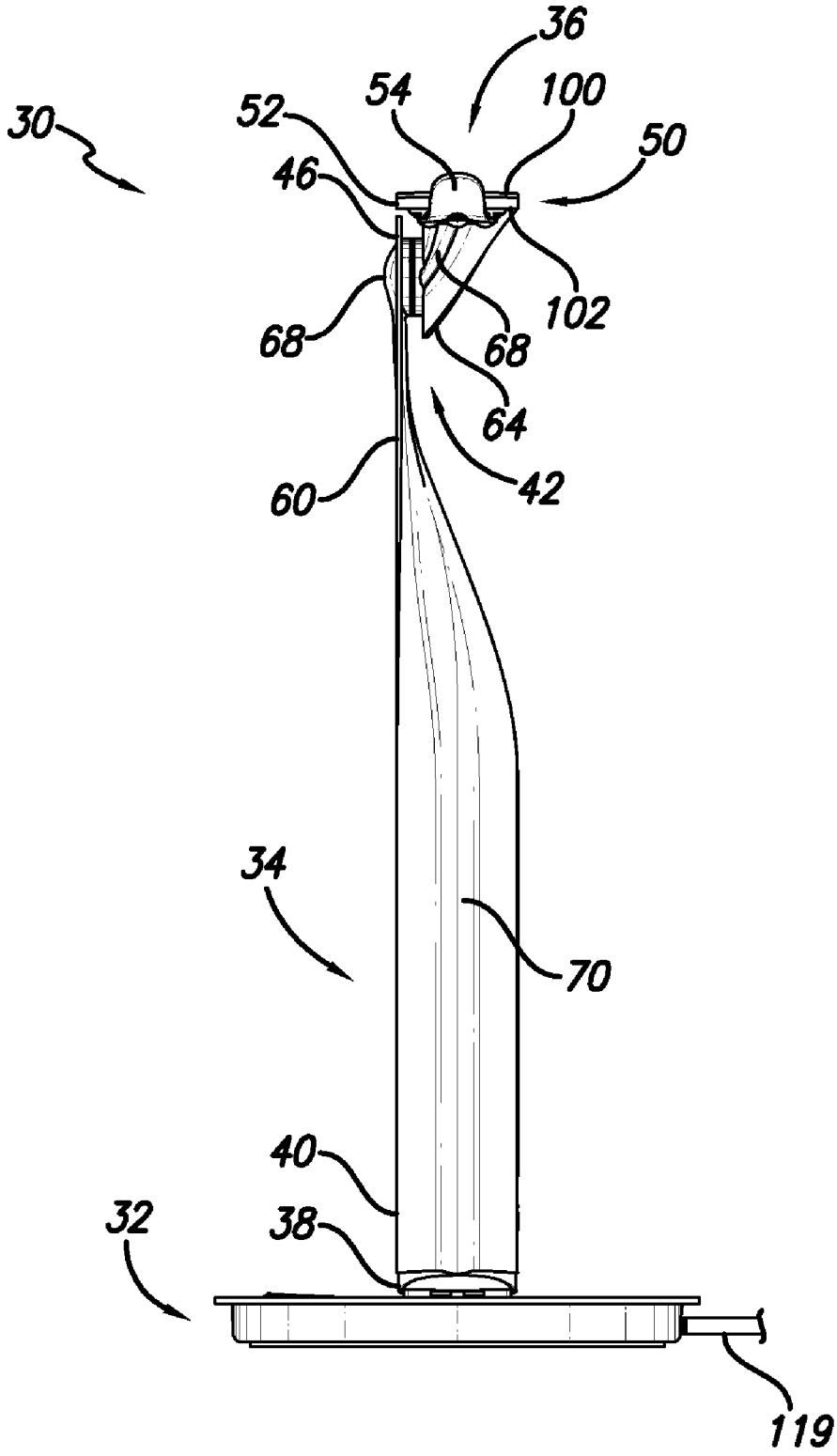
FIG. 3 is a front elevational view looking from a front or handle end of the head assembly.
Figure 4:
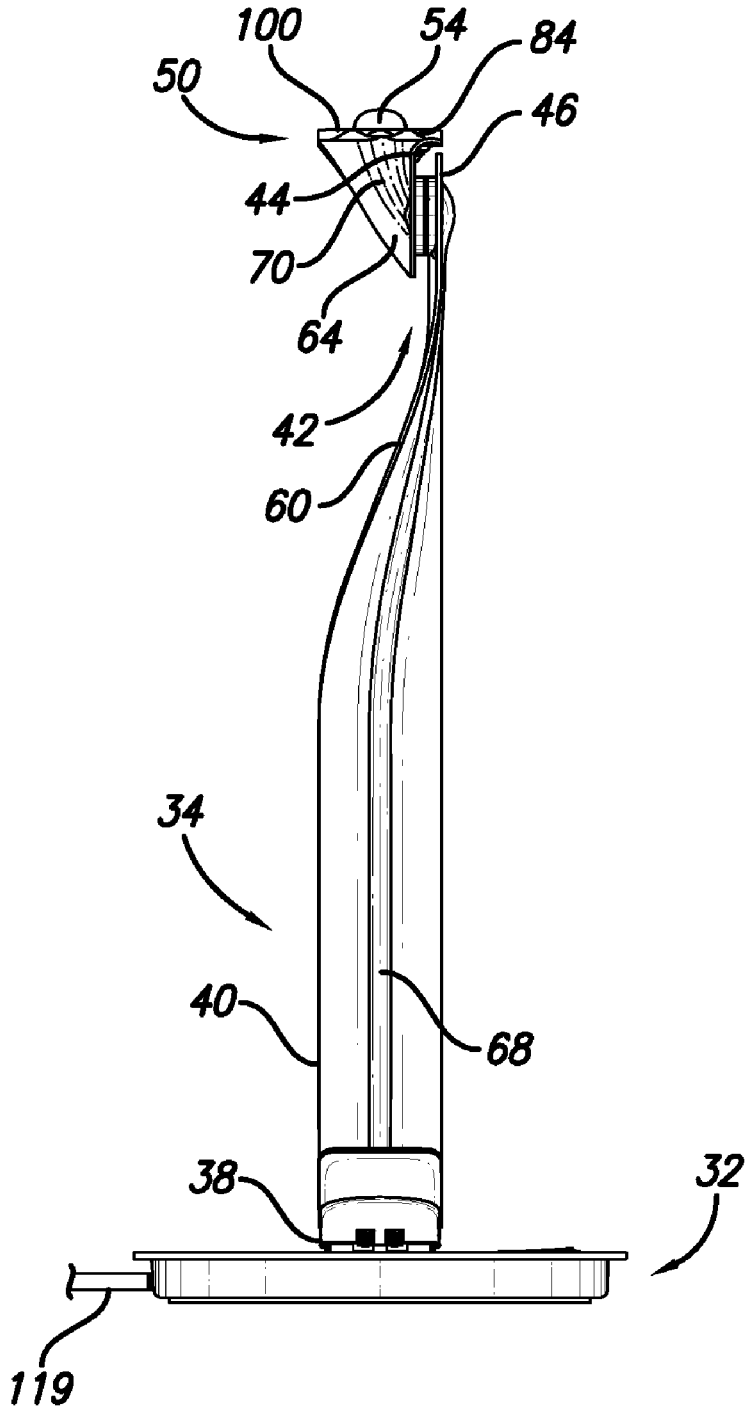
FIG. 4 is a rear elevational view of the lamp.
Figure 5:
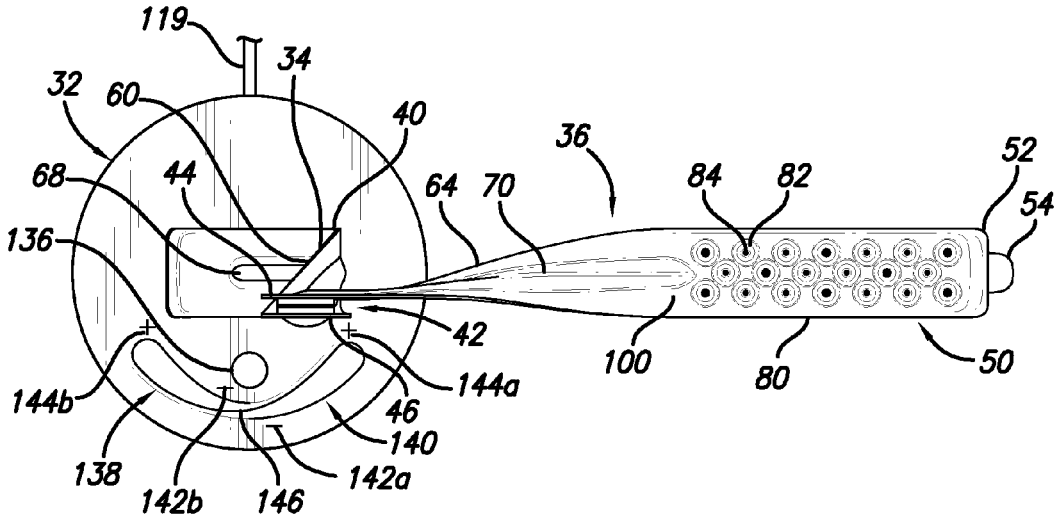
FIG. 5 is a top plan view of the lamp showing a plurality of passages provided in a first side of a head portion of the arm comprising a portion of the head assembly.
Figure 6:
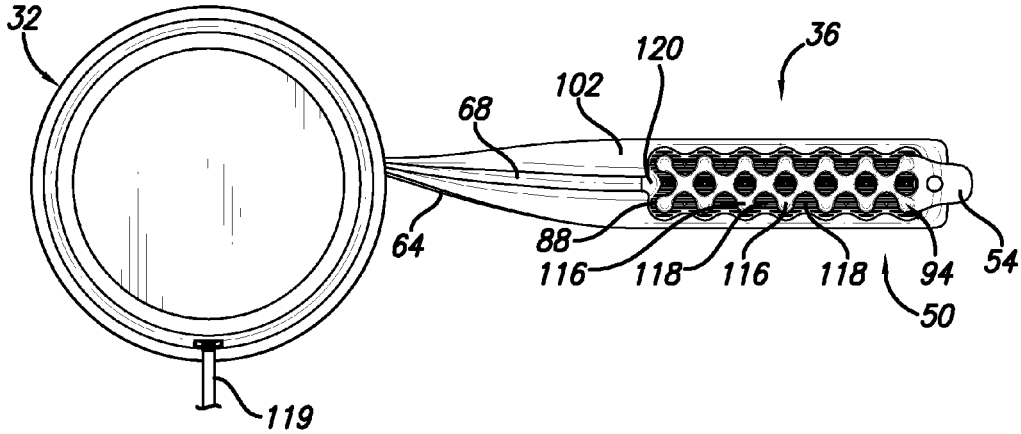
FIG. 6 is a bottom plan view on the lamp showing an array of lights of the head assembly and including a first heat sink and a cover structure including a plurality of lenses provided on a second side of the arm.
Figure 7:
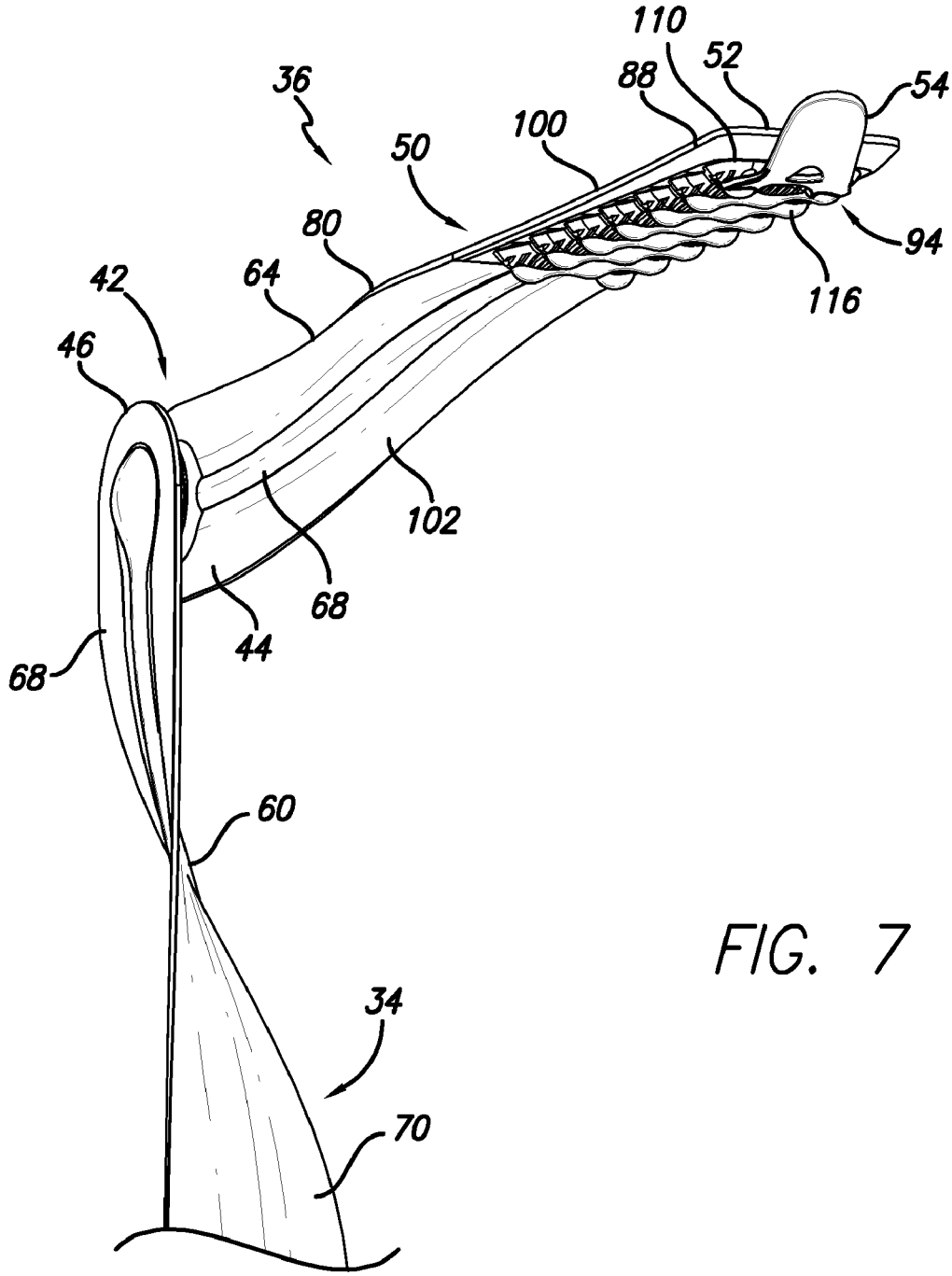
FIG. 7 is an enlarged front perspective view of the head assembly of the lamp to further illustrate the relationship of a first heat sink, cover structure and the second side of the arm.

The exemplification in the disclosure illustrates embodiments that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure and is not intended to be exhaustive or to limit the disclosure to the details of construction and the arrangements of components set forth in the following description or illustrated in the drawings.

With reference to FIG. 1, a lamp 30 is shown. The lamp 30 includes a base 32, a stem or body 34, and an arm 36. The body 34 is generally a vertically oriented structure which can pivot 37 relative to the base as a result of a first joint 38 positioned between the base and a proximal end 40 of the body 34. The first joint 38 can also be configured to allow rotation 41 of the body 34 relative to the base 32. The joint 38 will be described in greater detail below but is of generally known structure to one of ordinary skill in the art which allows pivoting and/or rotational movement of the body 34 relative to the base 32. A second joint 42 is provided between a proximal end 44 of the arm 36 and a distal end 46 of the body 34. The joint 42 allows pivotal movement 48 of the arm 36 relative to the body 34.

A head assembly 50 is provided on a distal end 52 of the arm 36. The head assembly 50 includes lights for producing illumination and structures which dissipate heat from the lights as will be described in greater detail herein. The head assembly 50 includes a handle 54 for moving the arm 36 without touching the lights or the arm.

With reference to FIGS. 2-8 and FIG. 12, the lamp is formed with a first twisted portion 60 in the generally planar body 34 and a second twisted portion 64 in the generally planar arm 36. While additional structures and components are provided in the head assembly 50 of the arm as described in greater detail below, the proximal portion 44 of the arm 36 is generally planar and includes the second twisted portion 64 which generally corresponds to the shape and dimension of the first twisted portion 60 of the body 34. The twisted portions 60, 64 allow the lamp 30 to be rotated at the second joint 42 with the arm 36 moved towards the body 34. When the arm is rotated to the maximum extent toward the body 34 the head assembly 50 and arm 36 nest against a corresponding surface of the body 34. The twisted portions 60, 64 allow the arm and body 36, 34 to nest into the allow the arm 36 to rotate about the joint 42 and extend away from the body 34.

When the arm 36 is extended from the body 34 the twisted portions 60, 64 result in the plain assembly 50 being oriented generally perpendicular to a corresponding plane of the body portion 34. The twisted portions 60, 64 generally result in a twist of the plane of the body 34 perpendicular to itself resulting in a generally 90° twist in the plane. The twist also allows the lamp (see FIG. 12) to be arranged in a aesthetically pleasing configuration when not in use.

A power line or cable 68 extends from the base 32 along a central portion of the body 34 upwardly to the joint 42. The cable 68 then extends along a central portion of the arm 36 to provide power to the head assembly 50. The cable 68 may be sandwiched between two layers comprising the body, each layer of the body having a corresponding channel formed therein to provide a cavity through which the cable 68 passes. Alternatively, a channel 70 is formed in one side of a single portion of material comprising the body 34 and the arm 36 with the cable 68 positioned in the channel 70 and being retained in the channel by adhesive, interference fit or other means.

Figure 13:
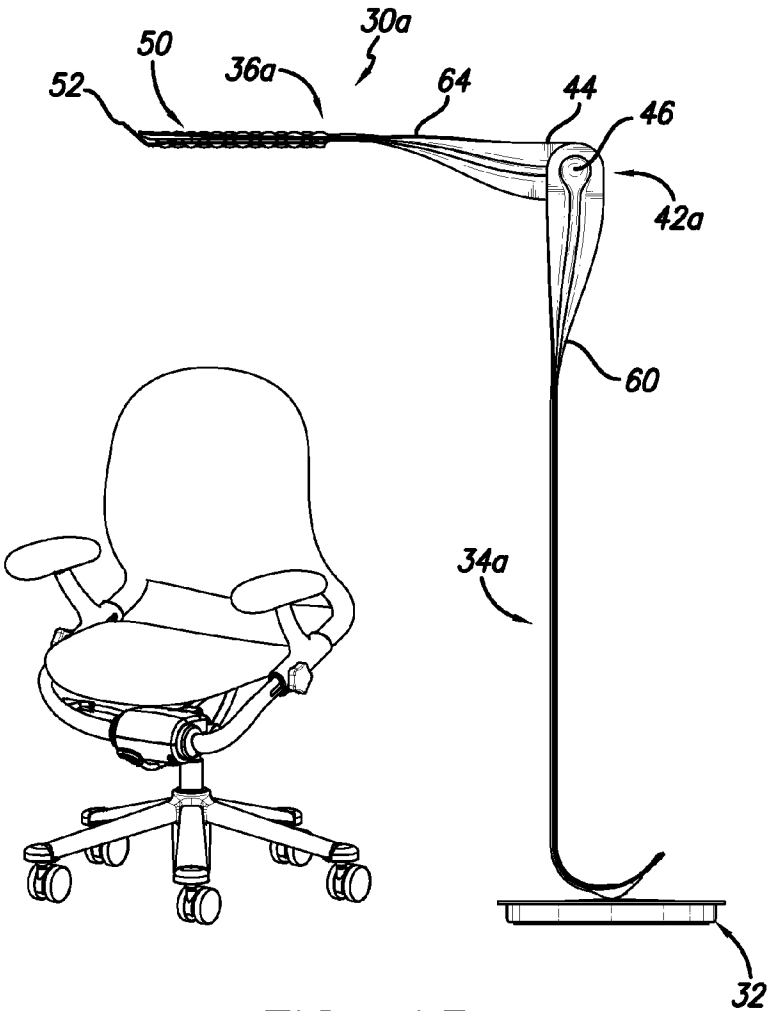
FIG. 13 is a view of a floor sized embodiment of the lamp.
Figure 12:
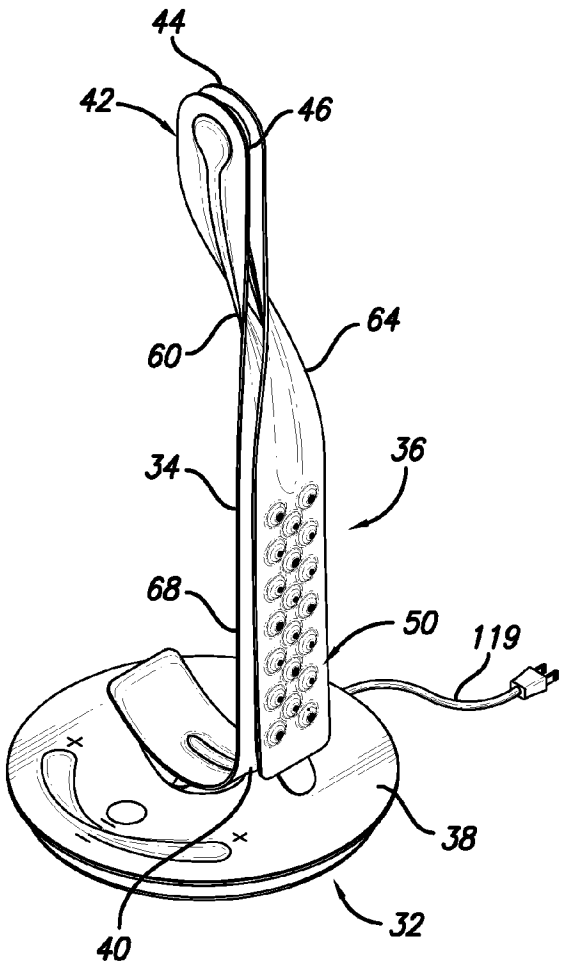
FIG. 12 shows a configuration of the lamp in which the arm has been rotated at the second joint so that the arm nests with the body as a result of twisted portions being cooperatively formed in corresponding sections of the distal body and the proximal arm.
Figure 14:
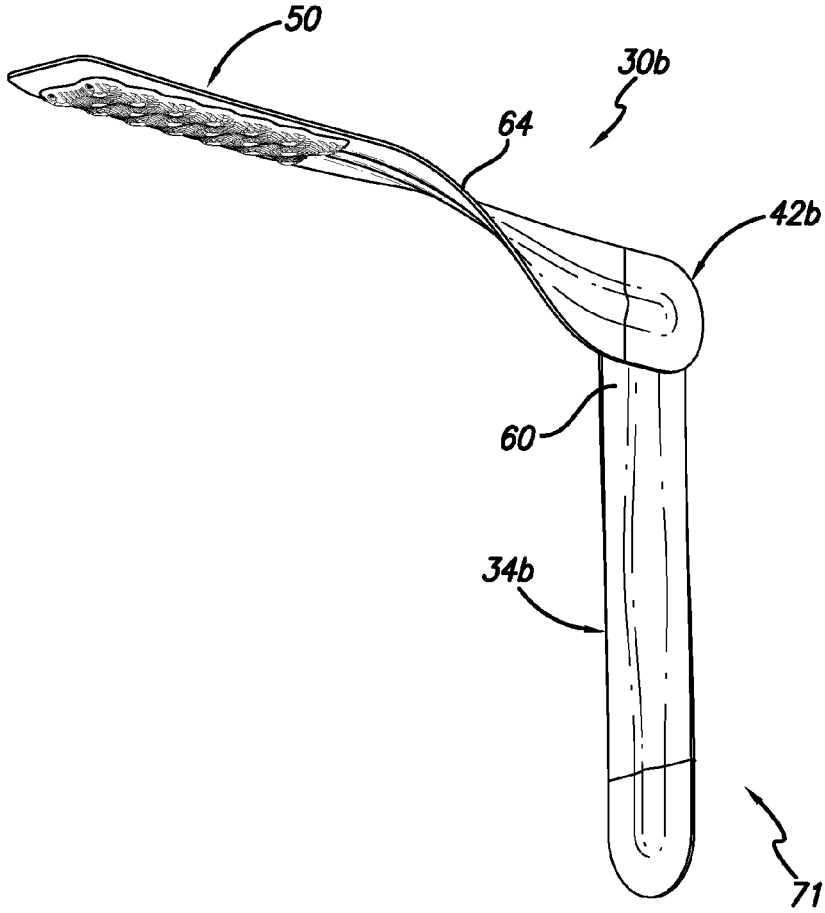
FIG. 14 is a view of a wall mountable embodiment of the lamp.
Figure 15:
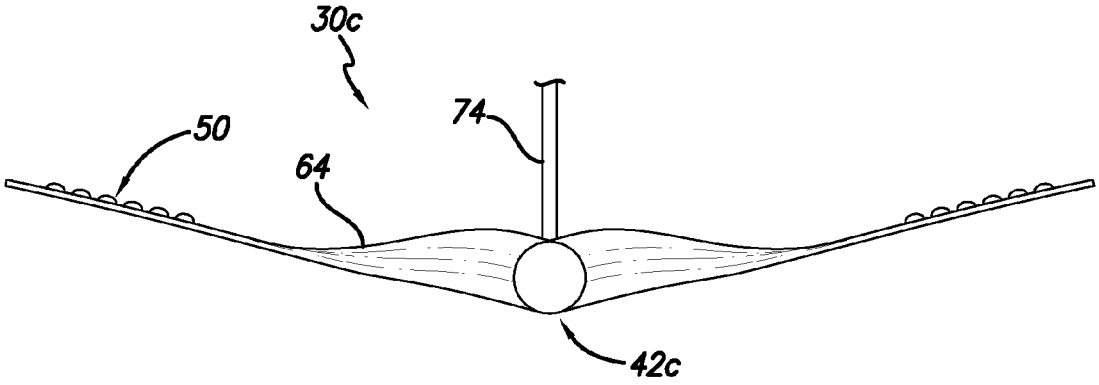
FIG. 15 is a view of a suspended embodiment of the lamp.

With reference to FIG. 13-15, alternate embodiments of the lamp include a floor embodiment (30*a*) (chair provided for scale), a wall mountable embodiment (30*b*), and a suspended embodiment (30*c*). Each of these alternative embodiments allow the head assembly 50 to be configured in an orientation to illuminate. The floor embodiment (30*a*) includes a body 34*a* and an extending arm 36*a*. The wall mountable embodiment 30*b* includes a body 34*b* which can be mounted to a surface such as, but not limited to, a wall 71. The surface 71 does not need to vertical and instead may be at any angle as the lamp 30 may be adjusted to a desired orientation relative to the body 34*b*. The suspended embodiment 30*c* can include a single arm 36*c* or multiple arms as shown. A first twisted portion 60 is not provided in the suspended embodiment shown in FIG. 15 but could be provided if a suspension portion 74 is provided in a planar design similar to that as shown in the body 34.

The various embodiments (30*a*, 30*b*, 30*c*) allow the head assembly 50 and the disclosed structures and methods to be utilized in a variety of different settings. The head assembly 50 of the present disclosure facilitates configuration in the variety of orientations to provide adjustable direction of the light emitted by the lamp. In all of the alternate embodiments, the twisted portions 60,64 may be provided. In this regard, the alternate embodiments of the lamp include a second joint 42*a*, 42*b*, 42*c*.

Figure 8:
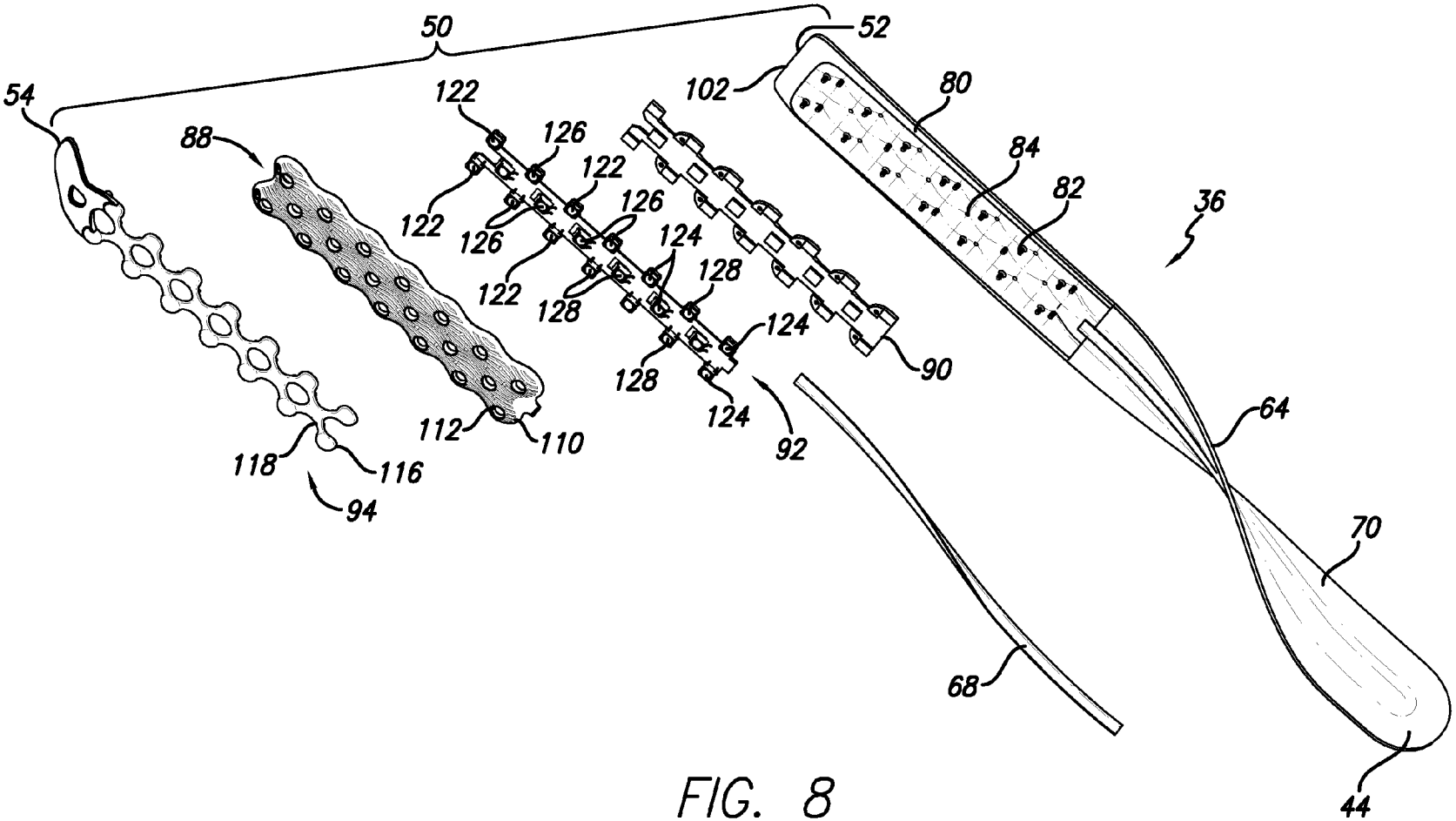
FIG. 8 is an exploded perspective view of the head assembly showing the first heat sink, a second heat sink, a printed circuit board positioned between the heat sinks and the cover structure positioned for overlying the first heat sink, lights are shown arranged on and attached to the printed circuit board, a cable is positioned for attachment to the printed circuit board to provide power and control to the lights, passages are provided in dimpled areas of the head portion of the arm, and openings are formed in the first heat sink.
Figure 10:
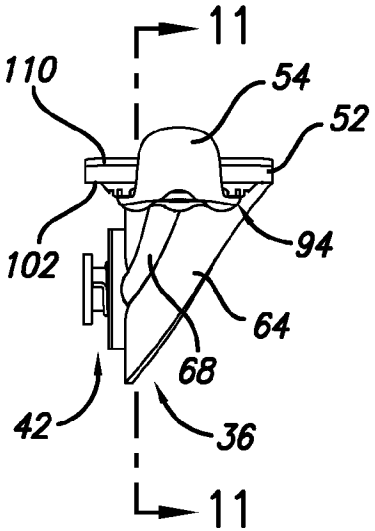
FIG. 10 is an enlarged front perspective view of the head assembly on the arm.
Figure 9:
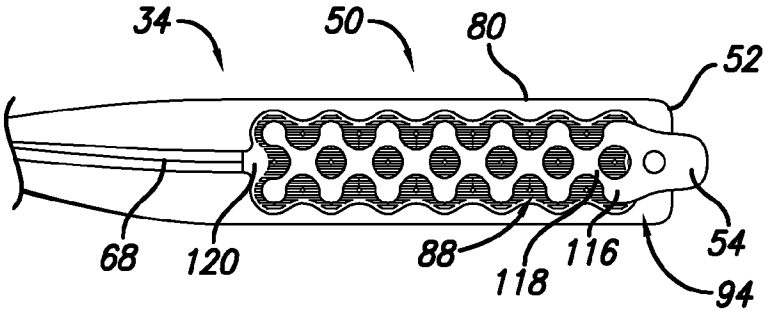
FIG. 9 is an enlarged plan view of the second side of the arm and the related head assembly components including the first heat sink, cover and corresponding power line.
Figure 11:
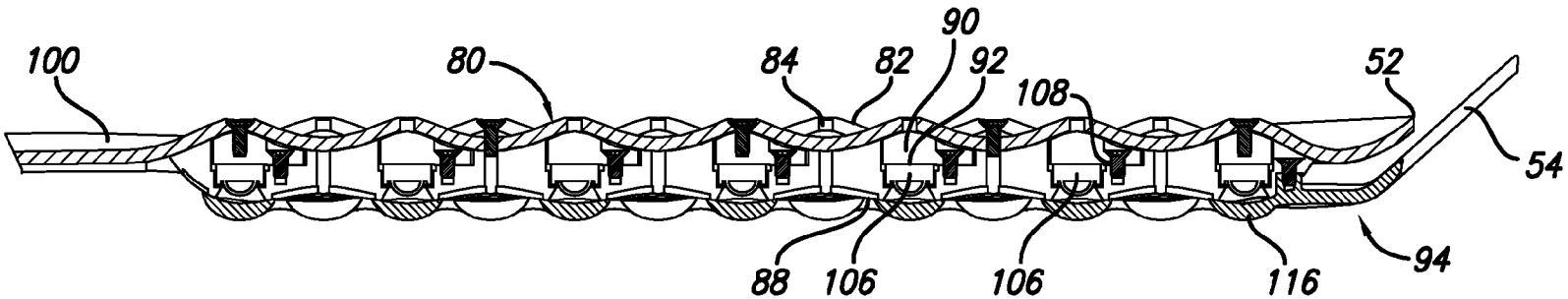
FIG. 11 is an enlarged, partial fragmentary, cross-sectional side elevational view taken a long line 11-11 in FIG. 10 to show the internal structure and relationships associated with the head assembly including the cover structure, first heat sink, second heat sink, a printed circuit board sandwiched between the first and second heat sinks, lights attached to the printed circuit board, and all the foregoing components being attached to the arm with fasteners, and openings formed through the arm proximate to the lights for transferring heat away from the lights.

Turning now to the structure and function of the head assembly 50, reference is made to all of the Figures with additional emphasis placed on the exploded perspective view of the head assembly 50 in FIG. 8. With reference to FIG. 8, the head assembly 50 includes a head portion 80 of the arm 36. A plurality of concave dimples 82 are formed in the head portion 80. Each of the dimples 82 includes a passage 84 extending through the material of the head portion 80. Additional components are layered or positioned relative to the head portion 80 including a first heat sink 88, a second heat sink 90, a printed circuit board 92 positioned between the first and second heat sinks 80, 90 and a cover 94 positioned over the first heat sink 88. These structures are layered relative to the head portion 80 to provide desired structures and functions. As shown, the head portion includes the first side or surface 100 (see FIG. 5) and a second side or surface 102. The components 88, 90, 92 and 94 are positioned against and retained on the second side 102.

With further reference to the figures, in particular FIGS. 7-11, the structures and methods of managing heat transfer and heat dissipation are described. As shown in the figures, the head portion 80 of the arm 36 is a generally flat or planar structure, except for dimples 82, having a relatively thin cross-sectional area. This generally planar structure is positioned above the light sources 106. The light sources 106 produced some measurable amount of heat energy as the result of being illuminated by electricity provided by the cable 68. The heat energy tends to flow upwardly when the arm is generally oriented as shown in the figures. As a preliminary heat transfer feature, the passages 84 in the dimples 82 facilitate flow of heat away from the lights 106. Additionally, the second heat sink 90 is positioned between the surface 102 and the printed circuit board 92 to help draw heat away from the lights 106. Additionally, the first heat sink 88 also draws heat energy away from the lights 106 to further dissipate heat. The heat sink 88 includes convex dimples 110. Generally centrally located in each of the dimples 110 is an opening 112. The openings allow light emitted from lights 106 out of the head assembly. The cover 94 is positioned over the first heat sink 88. The cover 94 is actually comprised of a series of individual lenses 116 which correspond to each of the light 106 locations extending through the corresponding opening 112. Bridges 118 are provided extending between and connecting the lenses each of the individual lenses 116 to provide a lattice structure for the cover 94. A distal end of the cover 94 includes the handle 54.

The lenses 116 of the cover 94 each can be optically configured to focus, diffuse or otherwise control the light as well as to be generally optically transparent. The control of the lenses allow each lamp to be configured for a specific application. For example, if the lamp is to be used with a variety of detailed small components the individual lenses 116 can be configured to focus the light in a desired orientation. If the light is being configured for use in reading or other task oriented activities, the individual lenses 116 can be configured to provide a more diffused or, perhaps, more generally optically transparent configuration. With the foregoing in mind, it is anticipated that the lens assembly 94 can be configured at any desired arrangement to achieve a desired purpose with the lights 106.

The configuration of the head assembly 50 and the various components used therewith (88, 90, 92, 94) allow for efficient manufacturing as well as other benefits. In this regard, the lamp 30 is assembled with the head assembly 50 being assembled with the use of one or more fasteners 108. For example, a single fastener 108 can be applied through the first side 100 and extending through the second side 102. The same fastener 108 can extend through the heat sink 90, printed circuit board 92, heat sink 88 and lens assembly 94 holding all the structures in a layered alignment. Additionally, alternate forms of fasteners 108 may be used such as snap fit, press fit or other devices. It is envisioned that a variety of fastening configurations may be developed based on the fundamental teaches of this disclosure and such additional embodiment are fully within the scope of the present disclosure and claims appended hereto.

In use, the lamp 30 of the present disclosure provides illumination and dissipation of heat from the lamp. The structures and methods of eliminating heat from the lamp provide a variety of benefits and all benefits associated with this lamp configuration are included in the present application and within the scope of the appended claims.

The lamp is assembled by assembling the body 34 to the base by means of a joint 38 which provides at least one degree of movement between the body 34 and base 32. It should be noted that a variety of joints 38 may be used in this configuration to provide additional degrees of movement and all connections are included within the present application. The arm 36 is attached at the second joint 42 to the body 34 to provide pivotable movement 48 of the arm relative to the body 34. It should be noted that while at least two joints 38, 42 have been identified, a lamp configuration with no joints and the head assembly 50 may be included in this disclosure. In other words, the head assembly 50 may be attached to a lamp structure other than that illustrated and described and still achieved the desirable benefits of the structures and functions of the head assembly 50. All such embodiments are intended to be included in this disclosure and the appended claims.

The cable extends from the base 32 along the body 34 and arm 36. A power cord 119 is attached to the base 32 to provide electricity to the base 32 and the components associated with the lamp 30. The arm 36 and body 34 include corresponding twisted portions 64, 60 which facilitate the nested or folded positioning of the arm 36 against the body 34. The orientation of the arm and body 36, 34 facilitates this nested positioning of these components and the orientation of the head assembly when the arm 36 is extended away from the body 34.

The head assembly 50 is configured with several layers of components, namely the first heat sink 88, second heat sink 90, printed circuit board 92 positioned between the heat sinks, and the cover 94 positioned over the first heat sink. The cable 68 connects to the printed circuit board 92 to provide power to the lights 106 carried on the printed circuit board 92. Convex dimples 110 are provided on the first heat sink 88 to house the lights 106 with the opening 112 extending through a generally central portion of the convex dimples 110. Concave dimples 82 are provided on the second side 102 of the arm 36 and passages 84 are formed through the dimples 82. The cable 68 is retained under a stub end 120 on the first heat sink 88 to retain the cable 68 relative to the printed circuit board 92 and heat sinks 88, 90.

With reference to the figures, heat transfer can occur as a result of ambient atmosphere contacting the convex dimples 110 of the first heat sink. Air flowing against these convex dimples carries away heat, which might be transferred directly from the light 106 to the first heat sink 88. Additionally, heat transferred from the lights 106 and the circuit board 92 may be transferred to the second heat sink 90. The second heat sink 90 spreads the heat over the entire heat sink mass and transfers the heat energy to the mass of the head portion 80 as well as through the openings of the passages 84. In this regard, the heat sink helps to create a convection flow through the head assembly 50 without the need for additional fans or other mechanisms for moving air. Spaces between the first heat sink 88 and the second side 102 as well as between the cover 94 and the heat sink 88 allow air to flow over the printed circuit board 92 upwardly toward the heat sink 90 and through the passages 84. This natural heat flow is created by convection currents induced by the heat sink 90.

While it has been noted that some heat transfer may occur to the head portion 90 of the arm 36, the configuration of the heat sinks 88, 90 and passages and openings 112, 84 reduces the heat transfer to the head portion 80. This may be beneficial so as to reduce the temperature of the head portion 80. As an additional matter, the handle or grip 54 provided on the cover 94 allows a user to grip a structure to move the orientation of the arm 36 without having to touch the head portion 80. This may be beneficial if the temperature of the head portion 80 is undesirable. However, due to the heat transfer mechanisms provided in the present disclosure, the temperature of the head assembly may be reduced sufficiently so as to allow user to touch the head portion 80 when adjusting the arm 36.

The lights 106 are generally solid state lighting technology, such as LED lights. The LED lights are of the type such as those which are produced by Nichia Electronics. For example, Nichia NCCL 023 cool LED may be used for the "cool" LEDs and Nichia NCCW023 may be used for the "warm" LEDs. These components can be directly attached to the printed circuit board 92 and provided as a sub-assembly for assembly with the arm 36.

The lights 106 can be arranged in particular groupings or patterns to provide improved light emission and control. For example, with reference to FIG. 8, the lights may be configured with two groups of cool LEDs and two groups of warm LEDs. The cool LEDs in the first group are identified with reference number 122 and cool LEDs in the second group are identified with reference number 124. The warm LEDs in the first group are identified with reference number 126 and warm LEDs in the second group are identified with reference number 128. Control of the temperature of the light the cool LED groups 122, 124 generally is controlled as a single group of cool LEDs and, similarly, the warm LED groups 126, 128 may be controlled as a single group of warm LEDs.

Figure 16:
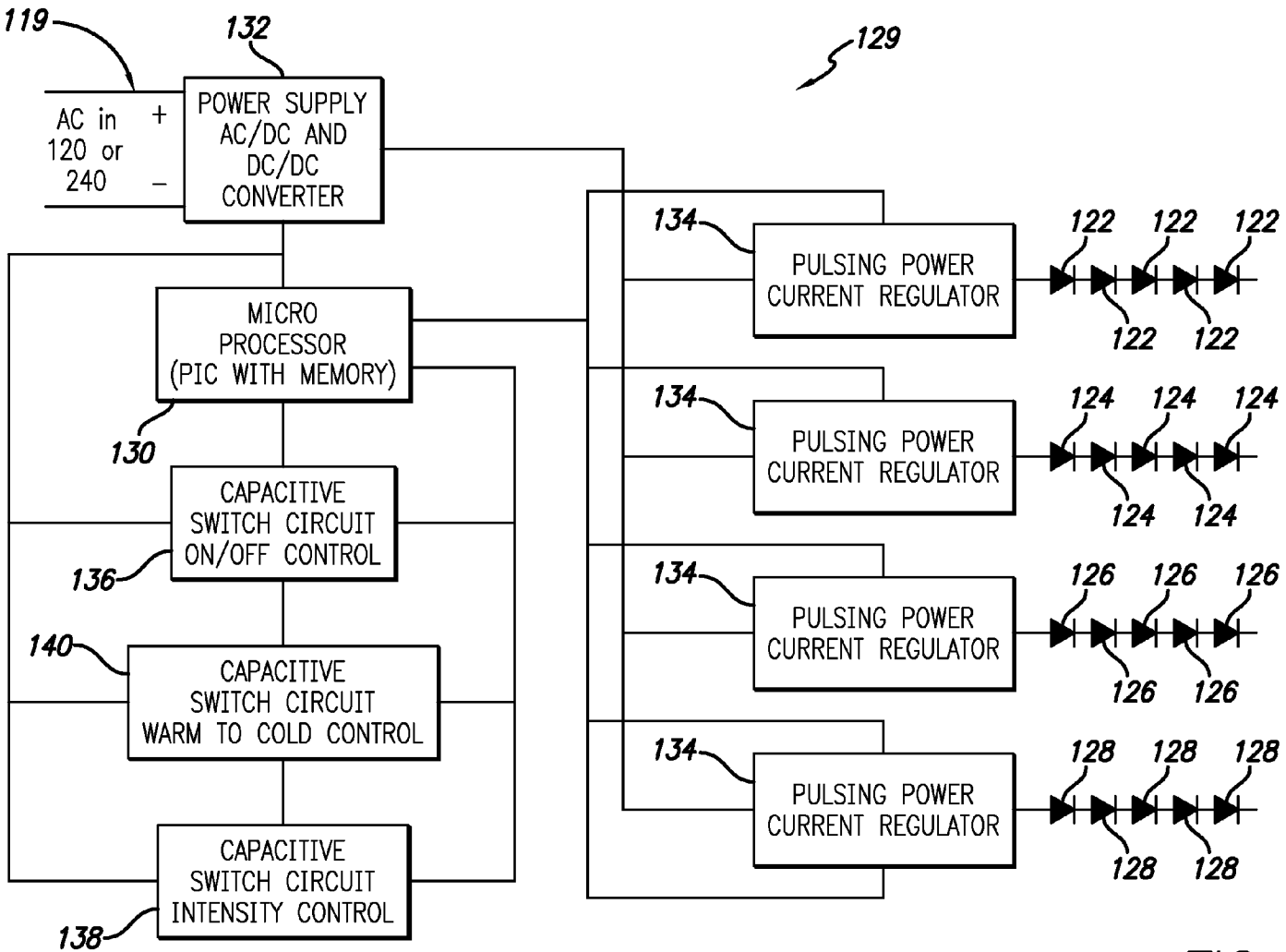
FIG. 16 is a general diagrammatic illustration of the lighting power and control system used in the lamp as disclosed.
Figure 17:
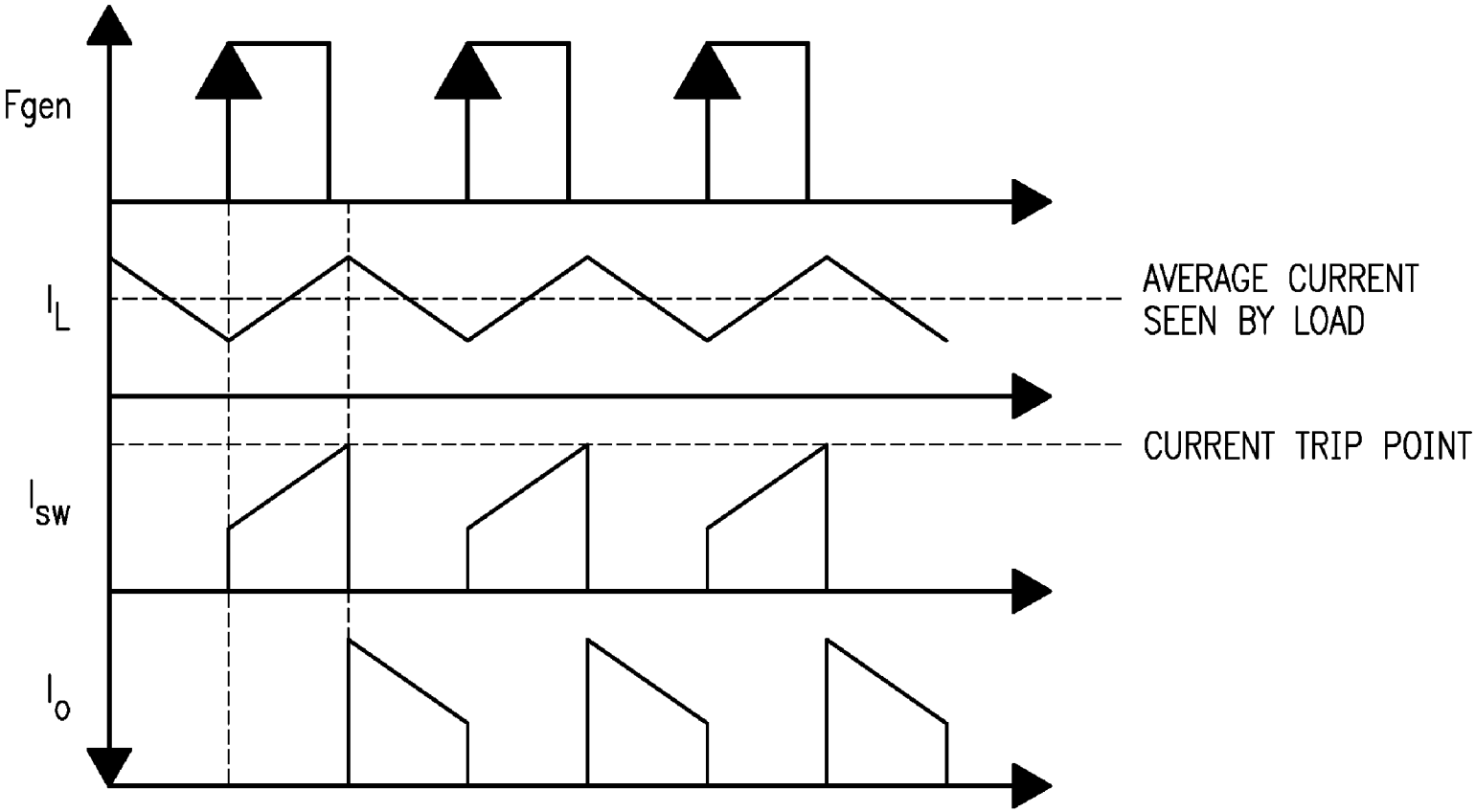
FIG. 17 is a timing and power diagram relating to pulsing technology used in the disclosed lamp.

With reference to FIG. 16, a general diagrammatic illustration of the control and power circuitry 129 is provided. In this regard, the cool LEDs 122, 124 and the warm LEDs 126, 128 are coupled to and controllable with a microprocessor 130. The power and control circuit 129 includes a power supply 132 which provides power to a series of current regulators 134 used to drive the corresponding LEDs. The microprocessor 130 is also coupled to the regulators 134 and the power supply 132. A series of controls are coupled to the microprocessor 130 and power supply 132. The controls as disclosed herein are capacitive but may be embodied in other forms as well. With regard to the controls as disclosed herein, a power on/off control 136 is provided. Additionally, an intensity control 138 is provided. Finally, a light temperature control 140 is provided.

The on and off control switch 136 merely allows the user to turn the power on and off. The on and off switch 136 can be provided on the base 32 or may be provided on the power cord 119. As disclosed, the capacitive control allows the lamp 30 to be turned on and off merely by touching the control 136.

The temperature control 140 and intensity control 138 provide similar functions but provide different results. The intensity control 138 relates to the light output from the lights 106. Intensity control 138 either can be in the form of controlling the energy to the light to increase or decrease the level of light output or by other techniques such as pulsing control. The pulsing control essentially turns the light on and off more frequently or less frequently. By reducing the percentage of on-time, the light is perceived to be dimmed or less intense.

The temperature control 140 uses similar techniques but uses the techniques to independently control warm and cool LEDs. On the present lamp, both controls 138, 140 can be provided to control the temperature of the light and to control the overall intensity of the selected light temperature. The user can control the temperature of the light using the light temperature control (See FIG. 1) from a more warm light (See "+" (144*a*) on the control 140 in FIG. 1, more warm light) to a more cool light (See "–" (142*a*), less warm light). This control 140 provide input to the microprocessor 130 to increase or decrease the relative intensity of the warm and cool LEDs. Increasing the intensity to the warm LEDs and deceasing the intensity of the cool LEDs, the light emitted by the lamp appears to be more warm. By increasing the intensity of the cool LEDs and decreasing the intensity to the warm LEDs, the light appears to be more cool. Once the user has selected the temperature of the light they can then increase or decrease the overall intensity of the selected settings. The intensity control 138 shown in FIGS. 1 and 5 allows for increased intensity (see "+" 144*b*) to less intensity (see "–" 142*b*). These controls allow the user to turn on and off the lamp (control 136), set a desired light temperature (control 140) and to set the desired intensity of the light (control 138).

With reference to FIG. 1, the controls are conductive and responsive to the user's touch. In this regard, a dual control is provided in which the narrow end of the control feature (for example, 140, 138) indicates a smaller or lower level and the larger portion of the control (for example 140, 138), indicates a larger or more intense setting. This controlled configuration provides both intuitive understanding of the meaning of the controls as well as a comfortable feel. For example, the controls 140, 138 may be provided in the form of recesses with a ridge 146 between the two control features 138, 140, keeping the control of the various control settings separate. Additionally, indicia such as blue transitioning to red can be provided on the light temperature control 140 and black transitioning to white can be provided on the intensity control 138. Other forms of indicia conveying information about the control features can be provided and are fully included within the scope of the present disclosure and the appended claims.

The configuration of the groups of LEDs, warm and cool, allow for a thorough and efficient mixing of the light emitted by the respective LEDs providing a pleasing result. The warm LEDs 126, 128 are grouped centrally with the cool LEDs 122, 124 grouped peripherally. This grouping may provide a slightly more warm light temperature in the central region of the light pattern emitted by the diodes and a slightly cooler light around the periphery. This may be pleasing and useful for activities such as reading and writing using the lamp in a task lighting configuration. Cool light provides additional illumination while the central warm LED groupings provide a warmer light temperature in the central focal region of the work area under the light.

While this disclosure has been described as having an exemplary embodiment, this application is intended to cover any variations, uses, or adaptations using its general principles. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

The invention claimed is:

1. An lighting assembly for use with a lamp, the lighting assembly comprising:

a platform;

a printed circuit board having a first side and a second side;

at least one solid state lighting device attached to the first side of the circuit board;

a first heat sink positioned proximate to the first side of the circuit board;

a second heat sink positioned proximate to the second side of the circuit board and between the circuit board and the platform; and a cover positioned over the second heat sink.

2. The lighting assembly of claim 1, further comprising passages formed in the platform for transfer of heat away from the second heat sink.

3. The lighting assembly of claim 1, further comprising concave dimples formed in the platform and at least one passage formed in each of the concave dimples for transfer of heat away from the second heat sink.

4. The lighting assembly of claim 1, further comprising opening formed in the second heat sink for allowing passage of light from the lighting device.

5. The lighting assembly of claim 1, further comprising convex dimples formed in the second heat sink and at least one opening formed in each of the convex dimples.

6. The lighting assembly of claim 4, further comprising the opening being sized and dimensioned to allow at least a portion of the lighting device to extend there through.

7. The lighting assembly of claim 1, further comprising at least one fastener extending through the platform, second heat sink, circuit board, and engaging the first heat sink for retaining the assembly on the platform.

8. The lighting assembly of claim 1, further comprising:

a plurality of lighting devices arranged on the circuit board;

a plurality of passages formed in the platform corresponding to the arrangement of the lighting devices on the circuit board for transfer of heat away from the second heat sink;

a plurality of openings in the first heat sink corresponding to the arrangement of the lighting devices on the circuit board for transfer of heat away from the first heat sink; and each of the openings formed in the second heat sink sized an dimensioned for allowing passage of light from the lighting device.

9. The lighting assembly of claim 8, further comprising the cover having a plurality of lenses configured corresponding to the arrangement of lighting devices on the circuit board.

10. The lighting assembly of claim 9, further comprising the lenses of the cover being connected by bridges.

11. The lighting assembly of claim 9, further comprising the lenses being generally optically transparent.

12. The lighting assembly of claim 9, further comprising the lenses being configured for focusing the light emitted by the lighting devices.

13. The lighting assembly of claim 9, further comprising the lenses being configured for diffusing the light emitted by the lighting devices.

14. The lighting assembly of claim 9, further comprising the lenses being configured for focusing the light emitted by the lighting devices, each lens being configured for directing light from the corresponding lighting device in predetermined direction.

15. The lighting assembly of claim 9, further comprising the cover being formed of a generally heat insulating material, a handle on the cover for gripping the lighting device.

16. The lighting assembly of claim 1, wherein the second heat sink is thermally coupled to the platform for transferring heat form the second heat sink to the platform to help dissipate heat from the lighting device.

17. The lighting assembly of claim 1, wherein a space is defined relative to the second side of the platform to provide a path for convection air currents to flow through the space, past at least the second heat sink and through the passages in the platform to help dissipate heat energy away from the lighting assembly.

18. The lighting assembly of claim 1, further comprising:

a plurality of lighting devices arranged on the circuit board;

a plurality of concave dimples formed in the platform corresponding to the arrangement of the lighting devices on the circuit board, each of the concave dimples having a passage there through for transfer of heat away from the second heat sink;

a plurality of convex dimples formed in the second heat sink corresponding to the arrangement of the lighting devices on the circuit board, each of the convex dimples having an opening there through for transfer of heat away from the first heat sink; and each of the openings formed in the second heat sink for allowing passage of light from the lighting device and the opening being sized and dimensioned to allow at least a portion of the lighting device to extend there through.

19. The lighting assembly of claim 1, further comprising:

a plurality of lighting devices arranged on the circuit board;

at least one of the lighting devices is a cool LED; and at least one of the lighting devices is a warm LED.

20. The lighting assembly of claim 19, further comprising:

a controller coupled to the circuit board;

each of the cool and warm LEDs being coupled to the controller through the circuit board;

a light intensity control coupled to the controller;

the light intensity control allowing a user to adjust the intensity of the light emitted by the lighting assembly by controlling the cool and the warm LEDs.

21. The lighting assembly of claim 19, further comprising:

a controller coupled to the circuit board;

each of the cool and warm LEDs being coupled to the controller through the circuit board;

a light temperature control coupled to the controller;

the light temperature control allowing a user to adjust the light temperature of the light emitted by the lighting assembly by controlling the cool and the warm LEDs.

22. The lighting assembly of claim 19, further comprising:

a controller coupled to the circuit board;

each of the cool and warm LEDs being coupled to the controller through the circuit board;

a light temperature control coupled to the controller;

the light temperature control allowing a user to adjust the light temperature of the light emitted by the lighting assembly by controlling the cool and the warm LEDs;

and the controller increasing the intensity of the cool LEDs and decreasing the intensity of the warm LEDs to provide a cooler light temperature, and the controller decreasing the intensity of the cool LEDs and increasing the intensity of the warm LEDs to provide a warmer light temperature.

23. The lighting assembly of claim 19, further comprising:

a controller coupled to the circuit board;

each of the cool and warm LEDs being coupled to the controller through the circuit board;

a light temperature control coupled to the controller;

the light temperature control allowing a user to adjust the light temperature of the light emitted by the lighting assembly by controlling the cool and the warm LEDs;

the controller increasing the intensity of the cool LEDs and decreasing the intensity of the warm LEDs to provide a cooler light temperature, and the controller decreasing the intensity of the cool LEDs and increasing the intensity of the warm LEDs to provide a warmer light temperature;

a light intensity control coupled to the controller;

the light intensity control allowing a user to adjust the intensity of the light emitted by the lighting assembly by controlling the cool and the warm LEDs independent of the light temperature control.

24. The lighting assembly of claim 1, further comprising the lighting assembly being attached to a desk lamp configuration.

25. The lighting assembly of claim 1, further comprising the lighting assembly being attached to a floor lamp configuration.

26. The lighting assembly of claim 1, further comprising the lighting assembly being attached to a suspended lamp configuration.

27. The lighting assembly of claim 1, further comprising the lighting assembly being attached to a wall mountable configuration.

28. A lamp comprising:

a base;

a body extending from the base;

an arm extending from the body;

a lighting assembly carried on the arm;

a printed circuit board having a first side and a second side;

at least one solid state lighting device attached to the first side of the circuit board;

a first heat sink positioned proximate to the first side of the circuit board;

a second heat sink positioned proximate to the second side of the circuit board and between the circuit board and the arm; and a cover positioned over the second heat sink.

29. The lamp of claim 28, further comprising a first joint moveably connecting the body to the base.

30. The lamp of claim 29, wherein the first joint allows the body to move relative to the base in at least one axis of motion.

31. The lamp of claim 28, further comprising a second joint moveably connecting the arm to the body.

32. The lamp of claim 31, wherein the second joint allows the arm to mover relative to the body in at least one axis of motion.

33. The lamp of claim 31, wherein the body and the arm have a generally planar configuration, the body including a first twisted portion and the arm including a second twisted portion, the first and second twisted portions being cooperatively located on the corresponding portions of the body and arm, respectively to facilitate the positioning the arm in a nested configuration proximate to the body.

34. The lamp of claim 31, further comprising:
a plurality of lighting devices arranged on the circuit board;
at least one of the lighting devices is a cool LED; and
at least one of the lighting devices is a warm LED.

35. The lamp of claim 31, further comprising:
a controller coupled to the circuit board;
each of the cool and warm LEDs being coupled to the controller through the circuit board;
a light intensity control coupled to the controller;
the light intensity control allowing a user to adjust the intensity of the light emitted by the lighting assembly by controlling the cool and the warm LEDs.

36. The lamp of claim 31, further comprising:
a controller coupled to the circuit board;
each of the cool and warm LEDs being coupled to the controller through the circuit board;
a light temperature control coupled to the controller;
the light temperature control allowing a user to adjust the light temperature of the light emitted by the lighting assembly by controlling the cool and the warm LEDs.

37. The lighting assembly of claim 31, further comprising:
a controller coupled to the circuit board;
each of the cool and warm LEDs being coupled to the controller through the circuit board;
a light temperature control coupled to the controller;
the light temperature control allowing a user to adjust the light temperature of the light emitted by the lighting assembly by controlling the cool and the warm LEDs;
and the controller increasing the intensity of the cool LEDs and decreasing the intensity of the warm LEDs to provide a cooler light temperature, and the controller decreasing the intensity of the cool LEDs and increasing the intensity of the warm LEDs to provide a warmer light temperature.

38. The lighting assembly of claim 31, further comprising:
a controller coupled to the circuit board;
each of the cool and warm LEDs being coupled to the controller through the circuit board;
a light temperature control coupled to the controller;
the light temperature control allowing a user to adjust the light temperature of the light emitted by the lighting assembly by controlling the cool and the warm LEDs;
the controller increasing the intensity of the cool LEDs and decreasing the intensity of the warm LEDs to provide a cooler light temperature, and the controller decreasing the intensity of the cool LEDs and increasing the intensity of the warm LEDs to provide a warmer light temperature;
a light intensity control coupled to the controller;
the light intensity control allowing a user to adjust the intensity of the light emitted by the lighting assembly by controlling the cool and the warm LEDs independent of the light temperature control.

39. The lamp of claim 31, wherein the controller is retained in the base.

40. The lamp of claim 35, wherein the light intensity control is positioned on the base.

41. The lamp of claim 36, wherein the light temperature control is positioned on the base.

* * * * *